United States Patent [19]

Cochran

[11] 4,015,662

[45] Apr. 5, 1977

[54] WELL TOOL WHICH CHANGES RECIPROCATING MOVEMENT TO ROTARY MOTION

[75] Inventor: Chudleigh B. Cochran, Houston, Tex.

[73] Assignee: Brown Oil Tools, Inc., Houston, Tex.

[22] Filed: Oct. 23, 1975

[21] Appl. No.: 625,259

[52] U.S. Cl. ..... 166/104; 173/73; 175/103

[51] Int. Cl.[2] ..... E21B 43/00; E21C 3/00

[58] Field of Search ..... 166/104, 311; 173/59, 173/73, 78; 175/103

[56] References Cited

UNITED STATES PATENTS

| | | | |
|---|---|---|---|
| 2,813,516 | 11/1957 | Dulaney | 175/296 |
| 2,873,093 | 2/1959 | Hildebrandt et al. | 173/73 |
| 2,943,603 | 7/1960 | Bassinger | 173/73 |
| 3,116,781 | 1/1964 | Rugeley et al. | 175/103 |
| 3,313,346 | 4/1967 | Cross | 166/.5 |
| 3,361,220 | 1/1968 | Brown | 173/78 |
| 3,722,594 | 3/1973 | Smith et al. | 166/311 |
| 3,791,447 | 2/1974 | Smith et al. | 166/311 |

*Primary Examiner*—James A. Leppink

[57] ABSTRACT

A well tool comprising: a tubular housing adapted for fluid communicable connection with the lower end of a pipe string; a piston assembly carried by the housing for relative axial movement therein from a first to a second terminal position in response to fluid pressure communicated through the pipe string to a first pressure area on the piston assembly; a valve assembly carried by the housing and movable from a closed position to an opened position, in response to predetermined axial movement of the piston assembly, to permit the pipe string fluid pressure to be communicated to a second pressure area on the piston assembly opposing the first pressure area and forcing the piston assembly to return to its first terminal position; and a working member carried by the housing for movement in response to reciprocal movement of the piston assembly.

21 Claims, 9 Drawing Figures

WELL TOOL WHICH CHANGES RECIPROCATING MOVEMENT TO ROTARY MOTION

BACKGROUND OF THE INVENTION

1. Field of the Invention

The present invention pertains to tools for use in subterranean wells. Specifically, the present invention pertains to tools suitable for making new hole in a well, cleaning out well conduits, and possibly reshaping or reaming well conduits or holes. More specifically, the present invention pertains to such well tools suitable for use with continuous coiled pipe operations but which may advantageously be used with any suitable fluid supply line, including conventional jointed pipe. As used herein, the term "fluid" is intended to include both liquids and gases.

2. Background of the Prior Art

Drilling a well requires expensive equipment and operation. Usually, the drill string comprises joints of pipe which are connected together as drilling progresses. In the past, it has been necessary, when changing a drill bit or in other operations, to pull the drill string, disconnecting and stacking the joined pipe. Such operations have generally required an expensive derrick and a considerable amount of time.

In the past, even working over a non-productive or malfunctioning well has required equipment capable of pulling strings of pipe and disconnecting the joints thereof. To eliminate derricks and associated equipment, some workover or remedial operations have been handled by running various tools into the well on a cable. However, cable workover methods have several limitations, including the inability to utilize fluid flow in the remedial operations.

In recent years, continuous pipe or tubing units have been developed to eliminate some of the problems of conventional workover operations. In the continuous tubing units, a continuous string of small-diameter pipe or tubing is coiled on a reel device and the continuous pipe is fed through an injector device which straightens the tubing and feeds it from the reel down into the well. Such an operation eliminates the need for a derrick and for the time-consuming operation of connecting and disconnecting joints of pipe. Examples of coiled tubing units may be seen in U.S. Pat. Nos. 3,116,781 and 3,313,346.

Coiled tubing units have been used for several types of workover operations. For example, wells having sand bridges which are filled with sand from top to bottom may be cleaned by injecting the continuous pipe into the well while circulating fluids therethrough. An example of such apparatus and method may be seen in U.S. Pat. No. 3,791,447. Coiled tubing units are also often used to "kick wells off," in place of gas-lifting or swabbing, by injecting nitrogen or natural gas into the well or by replacing workover fluid with diesel or lease crude. An example of such apparatus and method may be seen in U.S. Pat. No. 3,722,594. Production zones may be acidized, inhibited, sand consolidated, gravel packed, squeezed off or partially plugged back to shut off bottom water using coiled tubing units. Foreign matter, such as paraffin, may be removed from the tubing by circulation of hot oil or other solvents through continuous coiled tubing units. It will be appreciated that such units are highly flexible in workover operations.

However, there may be situations where circulation of a fluid through a coiled tubing unit will not remedy the problems of a potentially productive well. For example, the well tubing may become plugged with inoperative equipment or foreign matter which cannot be dissolved or washed out by circulation of fluids. In other cases, the production tubing itself may be corroded, deformed, or otherwise defective. In addition, although coiled tubing units are extremely flexible in workover operations, they have not been very suitable for drilling or making new hole in a well. This is probably due to the torsional stresses involved and the impractability of rotating a string formed from coiled tubing with the conventional drill bits and other rotary tools which are presently available.

SUMMARY OF THE INVENTION

In the present invention, a well tool is provided which is adapted for connection to the end of a fluid supply line. In the preferred form, the supply line is a continuous string of coiled tubing. The tool has been designed for reciprocal operation in response to the fluid pressures communicated thereto through the supply or pipe string. In a preferred form of the invention, the tool is provided with a working element which rotates in response to reciprocating movement of a piston assembly of the tool.

The well tool may comprise: a tubular housing in fluid communication with the lower end of the pipe string; a piston assembly carried by the housing for relative axial movement therein from a first to a second terminal position in response to communication of fluid pressure to a first pressure area on the piston assembly; a valve assembly movable from a closed position to an open position, in response to predetermined axial movement of the piston assembly, to permit pressure to be communicated to a second pressure area on the piston assembly to force the piston assembly to return to its first terminal position; and a working member carried by the housing for movement in response to the reciprocal movement of the piston assembly. In a preferred embodiment, the working member is mounted for rotation and means is provided for translating reciprocal movement of the piston assembly to rotating movement of the working member. In another embodiment, the working member is attached directly to the piston assembly and reciprocates therewith.

In the embodiment in which the working member is attached directly to the piston assembly, and where the working element rests, in use, against a firm surface, the fluid pressure and valve operation causes the housing and attached tubing to raise and lower relative to the stationary piston assembly and working element which in effect causes hammering blows to be delivered to the working member. This is particularly desirable for hammering out stubborn material, straightening deformed pipe or purposely reshaping the interior of a pipe with a broach, swaging tool or the like. If the material to be removed is relatively soft, the housing and tubing may remain stationary while the piston assembly and working member reciprocate with a hammering movement.

In the preferred rotating embodiment, the working member does not move axially relative to the housing. It rotates. This embodiment may also be used to remove unwanted and stubborn foreign matter which may become lodged in the well. In addition, its rotation makes it particularly suitable for drilling or making new hole in a well.

In either case, the tool is preferably attached to one end of a reel of continuous pipe and inserted into a well conduit, the continuous pipe being fed from a reel into the conduit until the tool reaches a preselected level. Then the tool is operated by applying hydraulic or pneumatic pressure thereto through the continuous pipe. As the drill tool advances, the continuous pipe is fed from the reel. The pressure communicated to the housing through the pipe string causes the piston assembly to move from a first terminal position to a second terminal position. A valve assembly is operable in response to a predetermined movement of the piston assembly to open for communicating fluid pressure to another part of the piston assembly forcing it to return from the second terminal position to its first terminal position. In addition to the punching or drilling performed by the tool, opening and closing of the valve serves to eject fluid through the tool, washing out or eroding unwanted foreign matter and removing cuttings or dislodged material from the well conduit.

With the drill tool of the present invention, continuous coiled tubing units can be made even more flexible and useful in working over wells and in actually making new hole in a well. Such flexibility and added capabilities result in more effective, efficient and economical use of the continuous coiled tubing units which are now available. Other objects and advantages of the invention will be apparent from a reading of the specification which follows in conjunction with the accompanying drawings.

DESCRIPTION OF A PREFERRED EMBODIMENT

Figure 1:
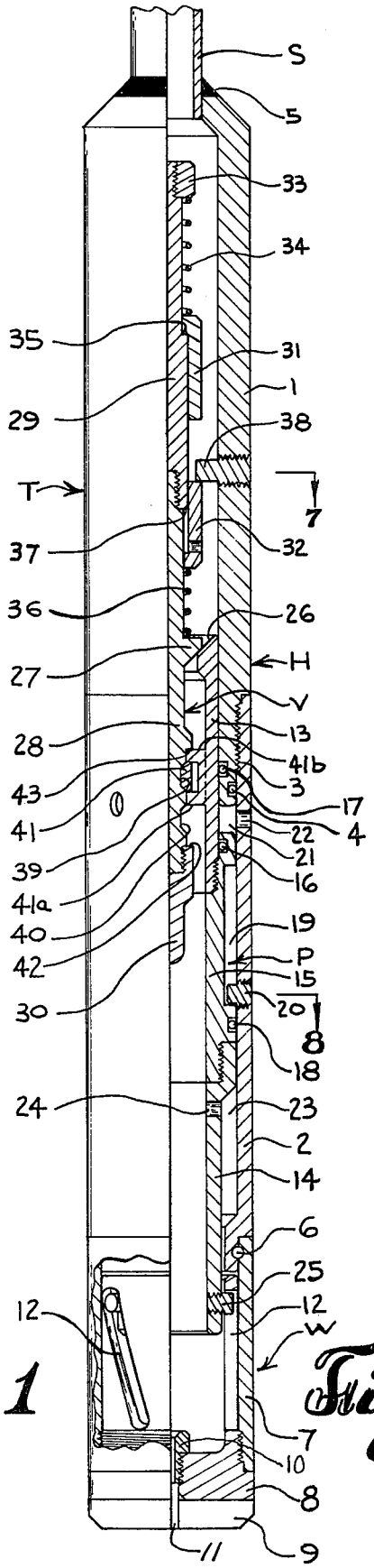
FIG. 1 is an elevation view, partially in section, of a well tool according to a preferred embodiment of the invention, having a rotating working member, and showing the piston assembly in its first terminal position.

Referring first to FIGS. 1–3 and 7–9, there is shown a well tool T, according to a preferred embodiment of the invention. The tool T may comprise a housing H, a piston assembly P, valve assembly V and a working element or member W.

The housing H may comprise a first tubular portion 1 and a larger internal diameter second tubular portion 2 sealingly connected by threads 3 and an annular seal 4. The upper tubular portion 1 may be connected in any suitable fashion to the lower end of a pipe string S which may be a string of jointed pipe or a continuous pipe string. As shown, the upper tubular section is connected by welding as at 5 but it may be threaded or connected in any other suitable fashion.

The working element or member W may be mounted on bearings 6 for rotation at the lower end of the housing section 2. As shown, the working member comprises a tubular body 7 and a plug 8 threaded thereto, which may be provided with cutting surfaces 9 or the like. A bushing 10 and port 11 may provide a fluid passage through the working element W. Internal helical slots 12 may be provided on the working member W for cooperation with other elements to be described hereafter to translate reciprocal movement of the piston assembly P to rotating movement of the working element W.

As shown in the drawings, the piston assembly P may comprise upper and lower tubular sections 13 and 14 connected by an intermediate tubular section 15. Seal 16 assures a fluidtight connection between the upper and intermediate sections 13 and 15. Annular seals 17 and 18 are provided between the piston assembly P and housing H so the piston assembly P can reciprocate within the housing H while maintaining fluidtight seals at these positions.

Figure 3:
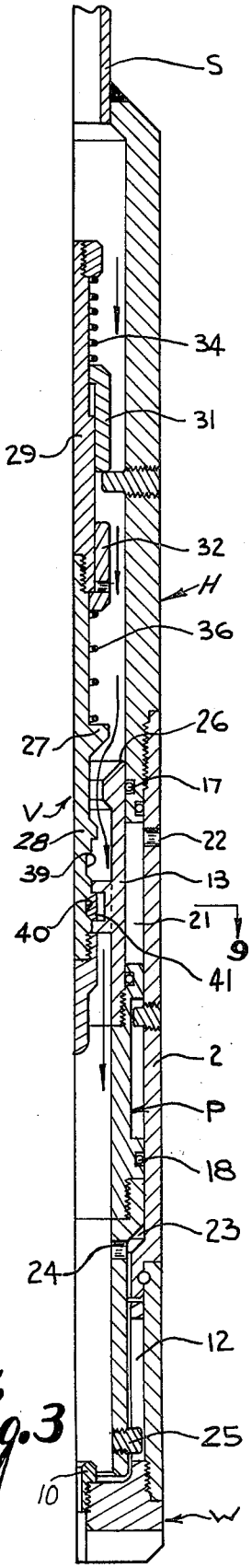
FIG. 3 is a quarter sectional elevation view of the well tool of FIGS. 1 and 2, showing the piston assembly in its second terminal position in which the valve is opened.

Cooperating longitudinal slots 19 in the intermediate piston section 15 and pins 20 carried by the housing section 2, allow limited reciprocal movement of the piston assembly P between a first terminal position, as shown in FIG. 1, and a second terminal position, as shown in FIG. 3, but prevent relative rotation between the piston assembly P and housing H.

It will be noted that there is a variable volume annular chamber 21 between the upper section 13 of the piston assembly P and the lower section 2 of housing H. This chamber 21 communicates with the exterior of the tool T through ports 22 and is consequently subjected to the pressure surrounding the tool T. There is also an annular chamber 23 between the lower section 14 of the piston assembly P and the lower section 2 of the housing H. This is not necessarily a sealed chamber but to provide better communication with the interior of the piston assembly P, a port 24 may be provided. Chambers 21 and 23 can be considered a single chamber of two compartments or portions.

It will be noted that the lower section 14 of the piston assembly P is provided with a plurality of pins 25 which engage the helical slots 12 of the working element W. Since the working element W cannot reciprocate, relative to housing H, it can be readily understood that reciprocation of the piston assembly P will cause the working element W to rotate first in one direction then in another, in response to movement of the pin members 25 from one end of the helical slots 12 to the other and back.

The upper end of the piston assembly section 13 is provided with a frusto-conical seating surface 26 sealingly engageable by a closure member 27 of the valve assembly V. The valve assembly V also includes a stem portion 28 on which the closure member 27 may be carried. An upper cylindrical member 29, which may also be considered a portion of the stem, is also provided. The lower portion of the stem may be provided with a plug or terminus 30.

Figure 7:
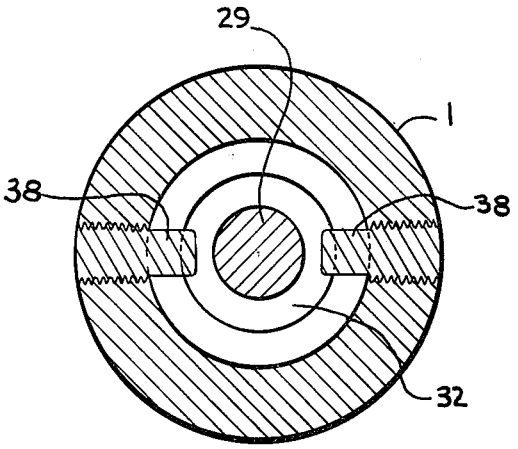
FIG. 7 is a cross sectional view of the embodiment of FIGS. 1–3, taken along line 7—7 of FIG. 1.
Figure 9:
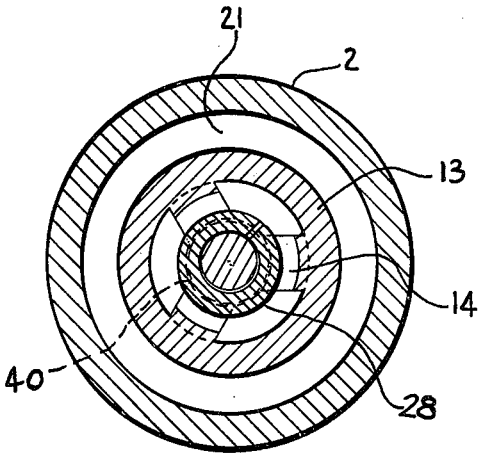
FIG. 9 is a cross-sectional view of the embodiment of FIGS. 1–3, taken along line 9—9 of FIG. 3.
Figure 8:
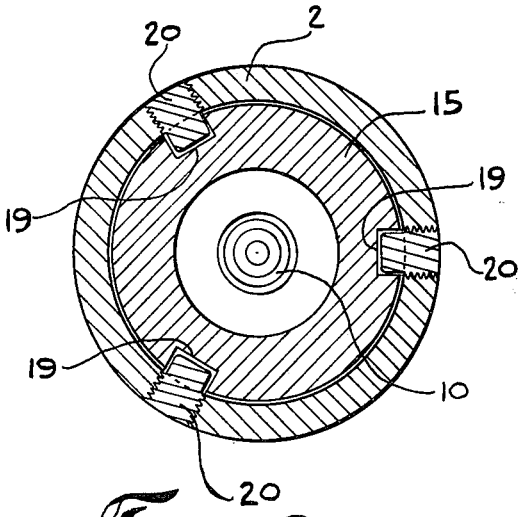
FIG. 8 is a cross-sectional view of the embodiment of FIGS. 1–3, taken along line 8—8 of FIG. 1.

Surrounding upper portions of the stem is a pair of collars 31 and 32 which cooperate, as will be more clearly understood hereafter, to limit and regulate movement of the valve assembly V. Mounted between a retaining ring 33 and the upper collar 31 is a spring 34 which biases collar 31 toward an upwardly directed shoulder 35 on the valve stem 29. Mounted between the closure portion 27 and collar 32 is another spring member 36 which biases collar 32 toward downwardly directed shoulder 37 on the valve stem 29. A plurality of pins 38, as best seen in FIG. 7, is provided on the upper housing section 1 for engagement with the collars 31 and 32 to limit, as will be more clearly seen hereafter, movement of the valve assembly V.

Figure 2:
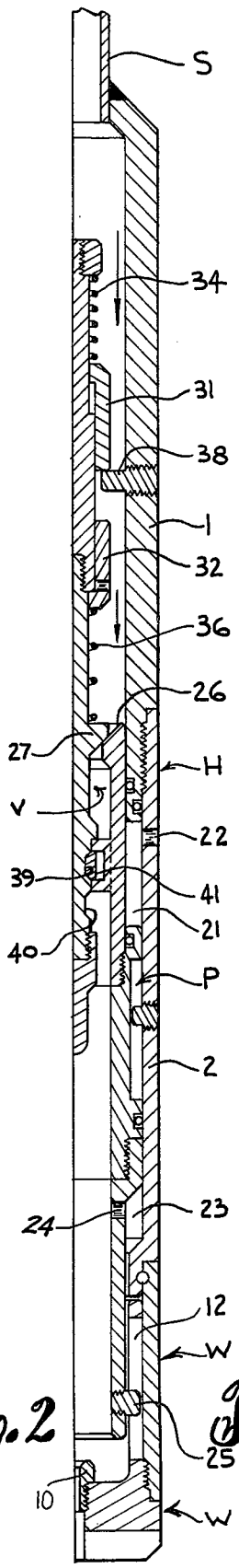
FIG. 2 is a quarter sectional elevation view of the well tool of FIG. 1, showing the piston assembly in an intermediate position.

The valve stem portion 28 is provided with a pair of axially spaced annular grooves 39 and 40 engageable by a plurality of inwardly biased latches 41 carried by the upper section 13 of the piston assembly P. When the latches 41 are engaging the upper groove 39, the valve assembly is in its closed position, the closure member 27 sealingly engaging the seat 26, as shown in FIGS. 1 and 2. When the latches 41 are in engagement with the lower groove 40, as best shown in FIG. 3, the valve assembly is in its open position with the closure member 27 unseated from the seat 26 allowing fluid flow, as indicated by the arrows in FIG. 3, from the pipe string P through the interior of the piston assembly P and the port 11 of the working member W.

Although the latches 41 are biased toward the grooves 39 and 40, due to the beveled edges of the latches and the cooperating beveled sides of the grooves, the latches can be radially retracted, if enough axial force is applied thereto so as to disengage one of the grooves, permit limited axial movement of the valve assembly V and reengage the other of the grooves. To limit relative movement between the valve assembly V and piston assembly P, upwardly directed shoulder 42 and downwardly directed shoulder 43 may be provided on the valve stem 28 for engagement with cooperating shoulders 41a and 41b, respectively, of the latch mounting.

It will be noted that when the valve assembly V is in its closed position, a total area on the valve assembly V and piston assembly P, equal to the cross-sectional area of the bore of upper housing section 1 will be subjected to the fluid pressure within the pipe string S, tending to force the valve assembly V and piston assembly P in a downward direction, assuming, as is the usual case, that the pressure surrounding the tool T is less than the pressure within the pipe string S. Actually, the only area of the piston assembly P which is subjected to this pressure is the area at the seat 26. However, when the valve is opened, the areas tending to force the piston assembly P in a downward direction are offset by equal areas tending to force the piston assembly P in an upward direction. Furthermore, an additional area, due to the difference in diameters at seals 17 and 18 is subjected to the pressure within the pipe string S tending to force the piston assembly P to return from the second terminal position of FIG. 3 to the first terminal position of FIG. 1. Again, this is assuming that the pressure externally of the tool T which is communicated to chamber 21 through port 22 is less than the pressure within the pipe string S.

STATEMENT OF OPERATION

In operation, the tool T is attached to the pipe string S and lowered into the well conduit or well hole. As previously stated, the pipe string S is preferably of the continuous type and may be fed from a coiled reel thereof. Once the tool T has been lowered into contact with unwanted foreign material in the conduit or the bottom of the well hole, whichever is the case, fluid is pumped under pressure into the pipe string S in a manner well known in the art. At this point in time, the tool will appear as shown in FIG. 1.

As pressure builds up, the piston assembly P and valve assembly V will be moved downwardly, toward the intermediate position of FIG. 2, the upper limiting collar 31 contacting pin 38 and compressing spring 34. Further compression of spring 34 will arrest movement of the valve assembly V, while the piston assembly P momentarily continues to move downwardly. As this happens, the latches 41 disengage groove 39, permitting relative axial movement between the valve assembly V and piston assembly P and reengagement of the latches 41 with the groove 40, as shown in FIG. 3. In this position, the second terminal position of piston assembly P, the valve is open and fluid pressure is communicated to the additional areas of the piston assembly P, particularly through ports 24, forcing the piston assembly P to return toward the first terminal position of FIG. 1.

As the piston assembly P returns toward its first terminal position, the upper limiting collar 31 disengages pin member 38 and the lower limiting collar 32 reengages the pin member 38 compressing spring 36 until a sufficient force exists to overcome the engagement of latch 41 with groove 40, allowing piston assembly P to continue further relative upward movement and allowing the latch 41 to reengage groove 39. As this happens, the closure member 27 reengages seat 26 and the tool T assumes the initial position of FIG. 1. Pressure is then built up in the pipe string S and the cycle repeated causing the piston assembly P to reciprocate within the housing H and the valve to be continuously opened and closed.

As the piston assembly P reciprocates, the engagement of pins 25 with the helical slots 12 of the working element W, causes the working element W to rotate first in one direction and then another. With this action, the cutting edges 9 break away or cut the foreign matter or new well hole as desired. Alternate opening and closing of the valve also causes fluid to be ejected through port 11, further aiding by erosive action in the material removal. In addition, the fluid may be returned to the surface of the well around the pipe string S to remove the cuttings of the tool T.

DESCRIPTION OF ANOTHER PREFERRED EMBODIMENT

Figure 4:
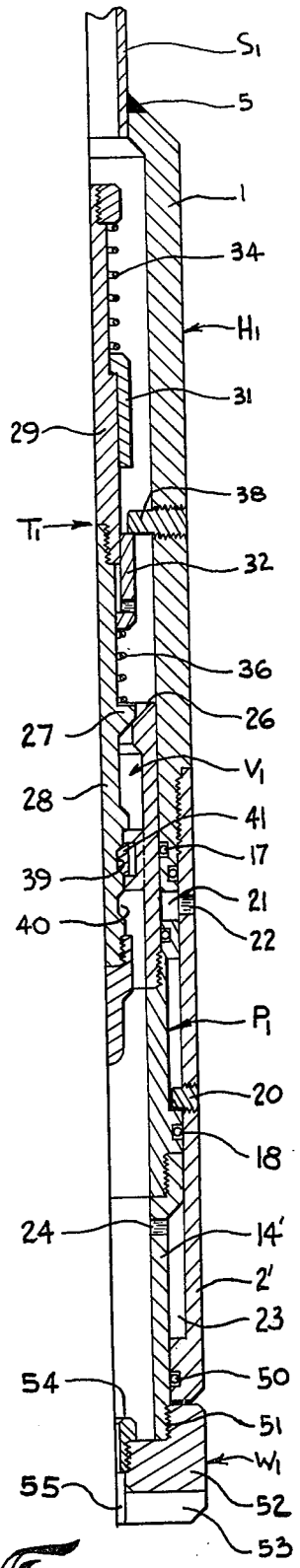
FIG. 4 is a quarter sectional elevation view of a well tool, according to another preferred embodiment of the invention, in which the working member reciprocates rather than rotating and showing the piston assembly in its first terminal position.
Figure 5:
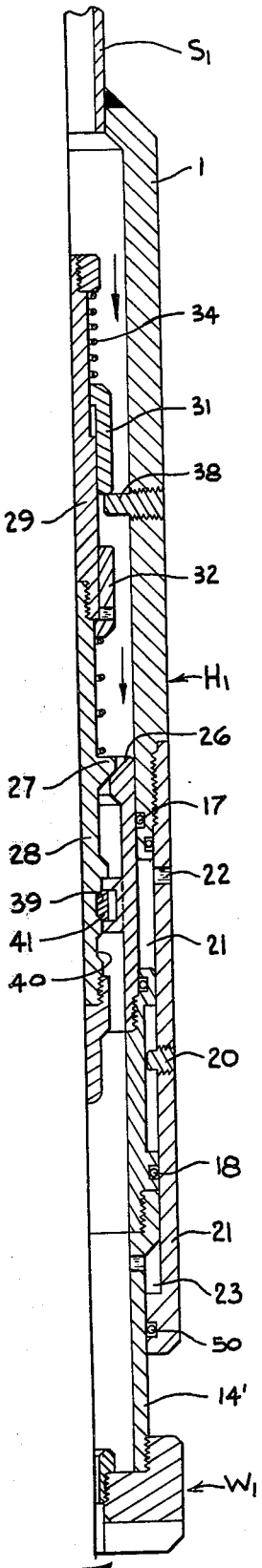
FIG. 5 is a quarter sectional elevation view of the embodiment of FIG. 4, showing the piston assembly in an intermediate position.
Figure 6:
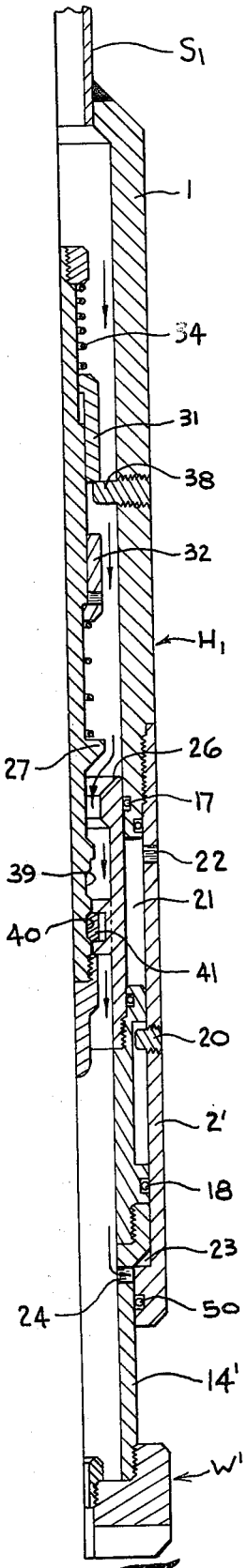
FIG. 6 is a quarter sectional elevation view of the embodiment of FIGS. 4 and 5, showing the piston assembly in its second terminal position, its valve being open.

Referring to FIGS. 4–6, another embodiment of the invention will be described in which the working element $W_1$ reciprocates instead of rotating as the working element of the previously described embodiment. In addition to the working element $W_1$, this tool $T_1$ also includes a housing $H_1$, piston assembly $P_1$ and valve assembly $v_1$. Most of its components are identical to the ones of the previous embodiment and will be referred to by the same numbers.

In fact, tool $T_1$ can be made simply by changing the lower housing section 2, the lower piston assembly section 14 and the working element W. In the embodiment of FIGS. 4–6, these elements are designated as 2′,14′,and $W_1$, respectively.

In this embodiment, the lower section 14′ of the piston assembly $P_1$ extends through the end of housing section 2′ for sliding and sealing engagement therewith. An annular seal 50 between the two sections assures such seal.

Instead of being rotatably mounted on the housing section, as in the previous embodiment, the working element $W_1$ of the present embodiment is attached to the lower section 14′ of the piston assembly $P_1$ by any suitable means, e.g., threads 51. The working element $W_1$ includes a body 52 and, in the present case, cutting surfaces 53. Although the working element $W_1$ is illustrated as of the bit type, it could be a broach, swag or any other working element desired for a particular job. Like in the other embodiment, the working element $W_1$ may be provided with a bushing 54 and port 55 to provide fluid communication between the interior and exterior of the tool $T_1$.

STATEMENT OF OPERATION

Operation of the tool $T_1$ is almost identical to the tool T of the previous embodiment. As pressure is built up in the housing $H_1$, with valve assembly $V_1$ closed, the piston assembly $P_1$ is forced from the first terminal position of FIG. 4 toward the second terminal position of FIG. 6. At some intermediate point such as shown in FIG. 5, movement of the valve assembly $V_1$ is arrested by stop pin 38 and limiting collar 31 causing the latches 41 to disengage the upper groove 39 and reengage the lower groove 40, as in FIG. 6. As this is done, the valve closure member 27 disengages the valve seat 26, opening the valve and permitting fluid flow as shown by the arrows in FIG. 6.

With the valve assembly $V_1$ in the position of FIG. 6, fluid pressure is communicated to the annular chamber 23 through port 24. Then, due to the differential areas of the piston assembly $P_1$, as more fully described with reference to the previous embodiment, a net upwardly directed force is exerted against the piston assembly $P_1$ forcing it to return toward the first terminal position of FIG. 4.

At some intermediate point on upward travel, second limiting collar 32 engages stop pin 38 and upon sufficient compression of spring 36 forces the latches 41 to disengage the lower groove 40 and reengage upper groove 39, again closing the valve assembly $V_1$. At this point, the tool $T_1$ will have reassumed the first position of FIG. 4. The cycle is then repeated.

As the piston assembly $P_1$ reciprocates within the housing $H_1$, the working element $W_1$ reciprocates therewith. If the foreign matter in the conduit is relatively soft, such as paraffin, the housing $H_1$ and the pipe string $S_1$ will remain relatively stationary, while the working element $W_1$ is extended as in FIGS. 5 and 6. However, it is more likely that the foreign material will be relatively hard, particularly where new hole is being made. In such a case, the working element $W_1$ and the piston assembly $P_1$ will remain relatively stationary while the housing $H_1$ and pipe string $S_1$ will move relatively thereto. In any event, it should be understood that the motions referred to in describing components of the invention are relative to each other.

CONCLUSION

The tool of the present invention can be used both in drilling and in workover or remedial operations. Depending on the particular working element selected, many jobs can be performed by the tool of the present invention. Although it is especially useful with continuous tubing of the type fed from reels, it can also be used with conventionally jointed pipe strings. In fact, many variations and uses of the invention can be made by those skilled in the art without departing from the spirit of the invention. It is therefore intended that the scope of the invention be limited only by the claims which follow.

I claim:

1. A well tool comprising:

a. a tubular housing connectable in fluid communication with the lower end of a pipe string;

b. a piston assembly carried by said housing for relative reciprocal movement therein between first and second terminal positions in response to fluid pressure communicated to said housing through said pipe string;

c. a working member carried by said housing for movement between first and second terminal positions in response to said reciprocal movement of said piston assembly;

d. valve means carried by said housing and having a closed position relative to said piston assembly blocking communication between said pipe string and a portion of said piston assembly, and an open position relative to said piston assembly permitting fluid communication between said pipe string and said portion of said piston assembly; and e. retainer means cooperative between said valve means and said piston assembly to retain said valve means in said closed position when said piston assembly is in said first terminal position, but releaseable responsive to predetermined movement of said piston assembly toward said second terminal position to permit movement of said valve means to said open position and fluid communication with said portion of said piston assembly or returning said piston assembly to said first terminal position.

2. A well tool as set forth in claim 1 in which said working member is rotatably mounted on said housing for limited rotating movement between said first and second terminal positions, said piston assembly and working member being provided with cooperating drive means for translating reciprocal movement of said piston assembly to rotating movement of said working member.

3. A well tool as set forth in claim 2 in which said cooperating drive means comprises a helical groove on one of said piston assembly and working member engaged by a pin member on the other.

4. A well tool as set forth in claim 3 in which said piston assembly and housing are provided with cooperating anti-rotation means for allowing reciprocal movement of said piston assembly but preventing relative rotating movement therebetween.

5. A well tool as set forth in claim 1 in which said working member is attached to said piston assembly for reciprocal movement therewith.

6. A well tool as set forth in claim 5 in which said piston assembly and housing are provided with cooperating anti-rotation means for allowing reciprocal movement of said piston assembly but preventing relative rotating movement therebetween.

7. A well tool as set forth in claim 1 in which said retainer means is re-engageable upon said movement of said valve means to said open position to retain said valve means in said open position when said piston assembly is in said second terminal position, releaseable responsive to predetermined movement of said piston assembly from said second terminal position toward said first terminal position to permit return movement of said valve means to said closed position, and re-engageable upon said return movement to again retain said valve means in said closed position.

8. A well tool as set forth in claim 7 in which said valve means comprises a closure member which, in said closed position, engages a seat carried by said piston assembly, and in said open position is spaced from said seat.

9. A well tool as set forth in claim 8 in which said closure member is attached to a stem member, said retainer means being cooperative between said stem member and piston assembly.

10. A well tool as set forth in claim 9 in which said retainer means comprises a pair of axially spaced grooves on one of said piston assembly and said stem member and radially biased and engageable latch means on the other.

11. A well tool as set forth in claim 9 in which said stem member and said housing are provided with cooperating limit means by which said closure member and stem member are permitted limited reciprocal movement with said piston assembly while said valve member remains in its closed or opened position, said limit means, upon predetermined movement of said piston assembly, arresting said limited movement of said closure and stem members to release said retainer means for movement of said valve member to its other position.

12. A well tool as set forth in claim 11 in which said limit means comprises stop means carried by said housing engageable with shoulder means carried by said stem member.

13. A well tool as set forth in claim 12 in which said shoulder means comprises at least one collar member slidably mounted around said stem member and biased toward said stop means by biasing means carried by said stem member.

14. A well tool comprising:

a. a tubular housing connectable in fluid communication with the lower end of a pipe string;

b. a piston assembly carried by said housing for relative reciprocal movement therein between first and second terminal positions in response to fluid pressure communicated to said housing through said pipe string, said piston assembly sealingly engaging said housing and defining at least one annular chamber therebetween;

c. a working member carried by said housing for movement between first and second terminal positions in response to said reciprocal movement of said piston assembly; and d. valve means carried by said housing blocking fluid communication between said pipe string and a portion of said piston assembly, when said piston assembly is in said first terminal position, but responsive to predetermined movement of said piston assembly toward said second terminal position to open and permit fluid communication with said portion of said piston assembly for returning said piston assembly to said first terminal position;

e. in which said piston assembly includes an annular surface within said annular chamber against which the pressure within said pipe string acts to force said piston assembly toward said first terminal position when said valve means is opened.

15. A well tool as set forth in claim 14 in which said piston assembly includes a second annular surface facing in a direction opposite to said first mentioned annular surface and in fluid communication with the exterior of said tool through a port in said housing.

16. A well tool as set forth in claim 15 in which said piston assembly is provided with an annular seal between said first and second annular surfaces sealingly isolating said first and second annular surfaces from each other in first and second portions of said chamber in communication with said pipe string and the exterior of said tool, respectively.

17. A well tool as set forth in claim 14 wherein said piston is tubular in configuration at least adjacent said chamber and has an opening therethrough providing communication between the interior of said piston assembly and said chamber.

18. A well tool comprising:

a. a tubular housing connectable in fluid communication with the lower end of a pipe string;

b. a piston assembly carried by said housing for relative axial movement therein from a first to a second terminal position in response to fluid pressure communicated through said pipe string to a first pressure area on said piston assembly;

c. valve means carried by said housing movable from a closed position to an open position, in response to predetermined axial movement of said piston assembly, to permit said fluid pressure to be communicated to a second pressure area on said piston assembly oppositely directed from said first pressure area and forcing said piston assembly to return to said first terminal position;

d. a working member carried by said housing for movement in response to a reciprocal movement of said piston assembly;

and e. retainer means cooperative between said valve means and said piston assembly to retain said valve means in said closed position when said piston assembly is in said first terminal position, but releaseable responsive to predetermined movement of said piston assembly toward said second terminal position to permit movement of said valve means to said open position.

19. A well tool as set forth in claim 18 in which said piston assembly comprises a first tubular portion, on which said first pressure area is carried, slidingly and sealingly engaging a reduced diameter portion of said housing and a second tubular portion of larger diameter, on which said second pressure area is carried, slidingly and sealingly engaging an enlarged diameter portion of said housing.

20. A well tool as set forth in claim 19 comprising an annular chamber between said piston assembly and said housing in fluid communication with the exterior of said tool and through which a third pressure area oppositely directed from said second pressure area is subjected to pressure surrounding said tool.

21. A well tool as set forth in claim 18 in which said working member is rotatably mounted on said housing, said piston assembly and working member having provided with cooperating drive means by which reciprocal movement of said piston member between said first and second terminal positions is translated to rotating movement of said working member.

* * * * *

UNITED STATES PATENT AND TRADEMARK OFFICE

CERTIFICATE OF CORRECTION

PATENT NO. 4015662

DATED April 5, 1977

INVENTOR(S) Chudleigh B. Cochran

It is certified that error appears in the above-identified patent and that said Letters Patent are hereby corrected as shown below:

In column 2, line 37, after "permit" insert --fluid--.

In column 6, line 64, delete "$v_1$" and insert therefore --$V_1$--.

In column 8, line 43, delete "or" and insert therefore --for--.

In columm 10, line 64, delete "having" and insert therefore --being--.

Signed and Sealed this

Thirtieth Day of May 1978

[SEAL]

Attest:

RUTH C. MASON
Attesting Officer

LUTRELLE F. PARKER
Acting Commissioner of Patents and Trademarks